US007204398B1

(12) United States Patent
Smith, Sr.

(10) Patent No.: US 7,204,398 B1
(45) Date of Patent: Apr. 17, 2007

(54) MULTI-PURPOSE WALLET/CELLULAR TELEPHONE CASE

(76) Inventor: Albert L. Smith, Sr., 412 E. 4th St., Eloy, AZ (US) 85231

( * ) Notice: Subject to any disclaimer, the term of this patent is extended or adjusted under 35 U.S.C. 154(b) by 510 days.

(21) Appl. No.: 10/753,652

(22) Filed: Jan. 8, 2004

Related U.S. Application Data

(60) Provisional application No. 60/439,112, filed on Jan. 10, 2003.

(51) Int. Cl.
*A45F 3/02* (2006.01)

(52) U.S. Cl. ..... 224/607; 224/600; 224/929; 150/144; 150/131

(58) Field of Classification Search ..... 150/106–108, 150/112, 114, 131, 136, 137, 139, 145, 147, 150/150, 144; D3/247, 250, 251, 253; 224/607, 224/257, 575–577, 262, 265, 192, 196, 623, 224/682; 206/38.1; 24/3.4; 40/661.06, 40/586, 644

See application file for complete search history.

(56) References Cited

U.S. PATENT DOCUMENTS

| | | | | | |
|---|---|---|---|---|---|
| 840,661 | A | * | 1/1907 | Rood | 150/139 |
| 1,758,297 | A | * | 5/1930 | Stanley | 206/38.1 |
| 2,446,009 | A | * | 7/1948 | Hyman | 150/139 |
| 2,511,533 | A | * | 6/1950 | Hyman | 150/139 |
| 2,582,447 | A | * | 1/1952 | Meyers | 150/117 |
| 3,354,925 | A | * | 11/1967 | Doppelt | 150/108 |
| 4,209,048 | A | * | 6/1980 | Sandos | 150/132 |
| 4,570,688 | A | | 2/1986 | Williams | |
| 4,744,497 | A | | 5/1988 | O'Neal | |
| 5,002,401 | A | * | 3/1991 | Blackman | 383/38 |
| 5,230,627 | A | * | 7/1993 | Todd | 150/135 |
| 5,244,135 | A | | 9/1993 | Nelson | |
| 5,513,789 | A | * | 5/1996 | Woods et al. | 224/572 |
| D380,606 | S | * | 7/1997 | Chen | D3/226 |
| 5,743,449 | A | | 4/1998 | McBride | |
| 5,829,657 | A | | 11/1998 | Romer, Jr. | |
| 2001/0027834 | A1 | * | 10/2001 | Southwick | 150/112 |
| 2001/0054245 | A1 | | 12/2001 | Williams | |
| 2002/0043545 | A1 | | 4/2002 | Tang | |

OTHER PUBLICATIONS

USA Today Newspaper; Friday, Sep. 27, 2002 Article entitled "ID Holders that can Hang in There".

* cited by examiner

*Primary Examiner*—Nathan J. Newhouse
*Assistant Examiner*—Margaret Olson
(74) *Attorney, Agent, or Firm*—John D. Lister

(57) ABSTRACT

A multi-purpose wallet/cellular telephone case includes a multi-sectional wallet unit having a central section and first, second, and third foldout sections that are integral with the central section. At least two of these sections are compartment sections. The first, second, and third foldout sections are hingedly connected to the central section whereby the foldout sections can be pivoted from first positions overlaying the central section to second extended positions for gaining access to an interior of the case. The central, second and third sections have a common flexible back panel secured thereto that forms a pocket with the sections for holding paper currency. An external pocket is located on the flexible back panel of the case for holding a cellular telephone. A releasable fastener releasably holds the first, second, and third sections in their first positions and the case may include a strap.

3 Claims, 2 Drawing Sheets

MULTI-PURPOSE WALLET/CELLULAR TELEPHONE CASE

This patent application is a continuation-in-part of provisional patent application No. 60/439,112, filed Jan. 10, 2003.

BACKGROUND OF THE INVENTION

The subject invention relates to a multi-purpose wallet/cellular telephone case. The multi-purpose wallet/cellular telephone case of the subject invention provides an inexpensive, compact, durable, easy to use, unobtrusive carrier for holding or retaining a cellular telephone and other items such as, but not limited to, picture identification, a drivers license, credit cards, debit cards, telephone cards, coins, and currency that individuals commonly desire to have on their person. While the multi-purpose wallet/cellular telephone case may be used for activities such as shopping, going to entertainment and athletic events, etc., the multi-purpose wallet/cellular telephone case of the subject invention is particularly well suited for outdoor activities where and individual desires to have such items on their person but does not want to be encumbered by the items. Thus, the multi-purpose wallet/cellular telephone case of the subject invention is particularly well suited for use by individuals who are exercising or otherwise engaged in outdoor activities such as but not limited to walking, jogging, bicycle riding, skiing, hiking, horseback riding, all terrain vehicle riding, and snowmobile riding. In addition, the multi-purpose wallet/cellular telephone case of the subject invention is well suited for current air travel where the individual is subjected to repeated security checks that require easy access to their identification and the persons need to have their hands free for carrying carry-on luggage, etc.

SUMMARY OF THE INVENTION

The multi-purpose wallet/cellular telephone case of the subject invention includes a multi-sectional wallet unit having a central section and first, second, and third foldout sections that are integral with the central section. Preferably, the central section includes a key holder and the three foldout sections are compartment sections for housing different items that persons commonly carry such as, but not limited to, picture identification, a driver's license, credit cards, debit cards, telephone cards, and coins. The first, second, and third foldout sections of the case are hingedly connected to the central section of the case whereby the foldout sections can be pivoted from first positions overlaying the central section of the case to second extended positions for gaining access to an interior of the case and items held within the case. The central, second and third sections have a common flexible back panel secured thereto that forms a pocket with the sections for holding paper currency. An external pocket is located on the flexible back panel for holding a cellular telephone. A releasable fastener releasably holds the first, second, and third sections of the case in their first positions and the case may include a strap for securing the case to a user such as but not limited to a neck strap.

DESCRIPTION OF THE PREFERRED EMBODIMENTS

Figure 1:
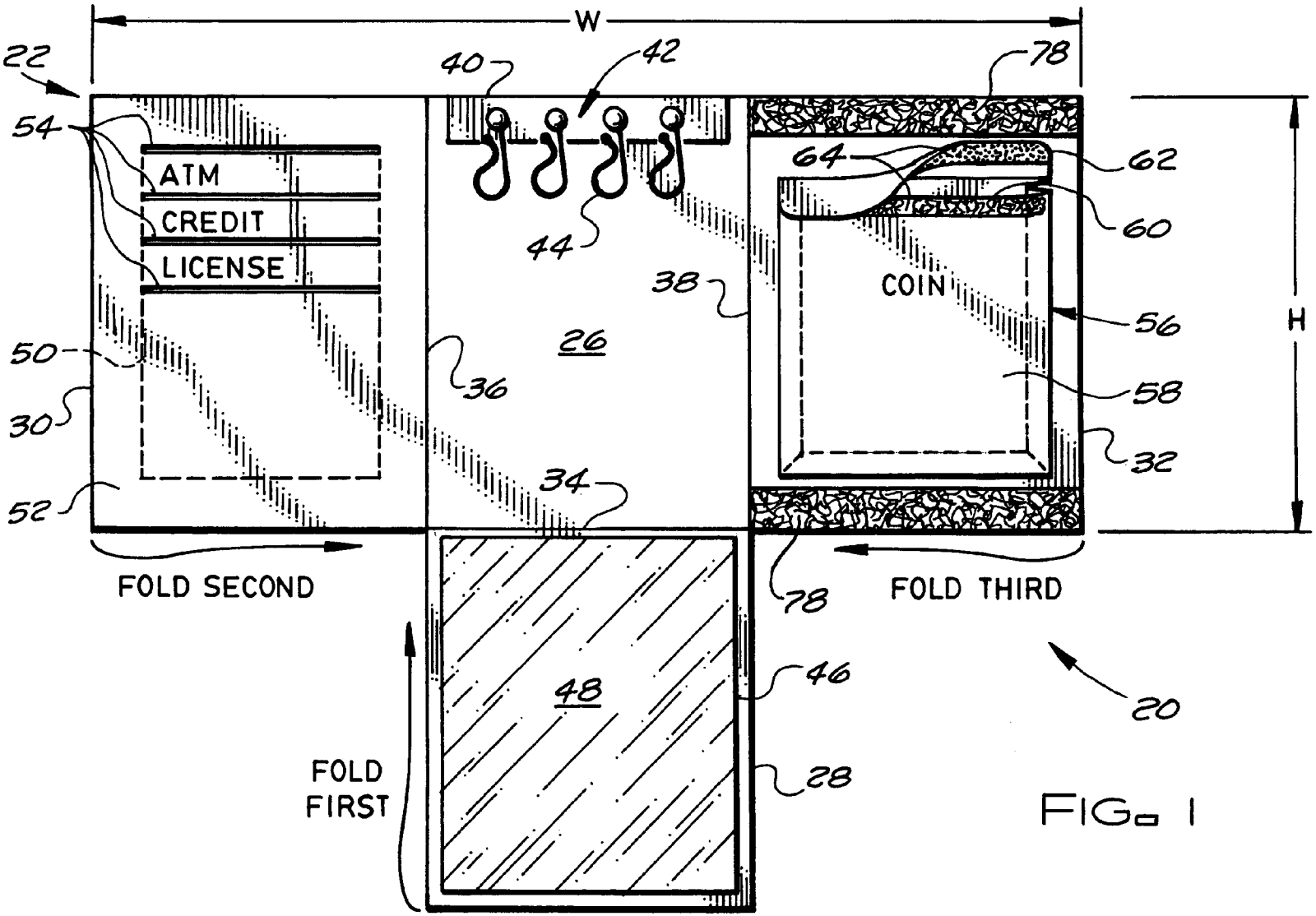
FIG. 1 shows an inside view of the wallet/cellular telephone case with first, second, and third foldout sections of the case unfolded from the central section of the case to expose an interior of the case.
Figure 2:
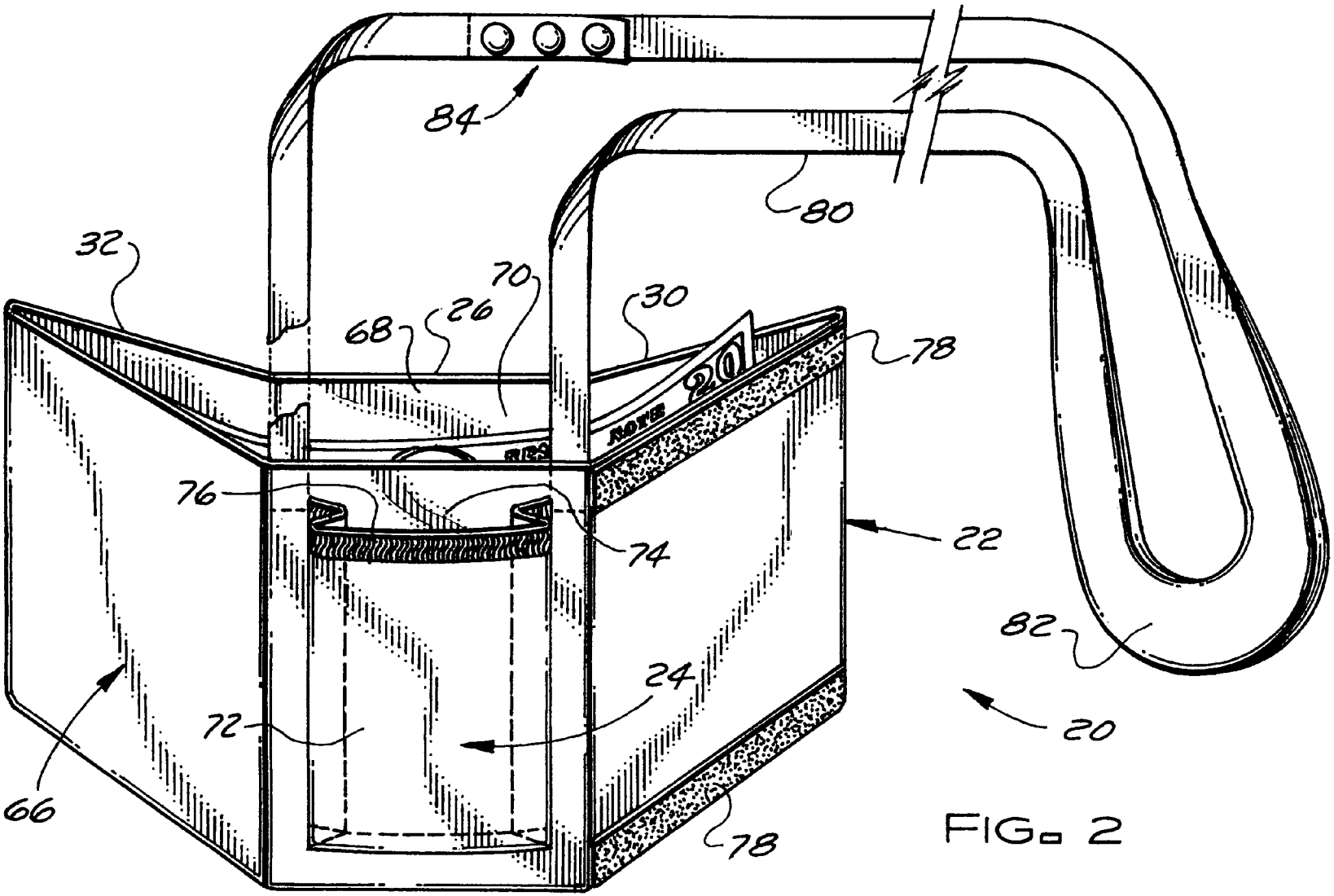
FIG. 2 shows an outside perspective view of the wallet/cellular telephone case with the first foldout section folded up over the central section so that the first foldout section of the case is not visible.

The multi-purpose wallet/cellular telephone case 20 of the subject invention shown in FIGS. 1 and 2 includes a multi-sectional wallet unit 22 and a cellular telephone case 24 for housing a cellular telephone. The multi-sectional wallet unit 22 has a central section 26 and a first foldout section 28, a second foldout section 30, and a third foldout section 32 that are integral with the central section 26. At least two of the sections (26, 28, 30, and 32) are compartment sections.

The central section 26 of the multi-sectional wallet unit 22 is rectangular with first, second, third and fourth edge portions 34, 36, 38, and 40. The first edge portion 34 is opposite the fourth edge portion 40 and the second edge portion 36 is opposite the third edge portion 38. As shown in FIG. 1, the central section 26 of the multi-sectional wallet unit 22 has a key holder 42 formed by a series of hooks 44 conventionally secured to the section by rivets or other conventional fasteners.

The first foldout section 28 of the multi-sectional wallet unit 22 is rectangular and has an edge portion hingedly connected to the first edge portion 34 of the central section whereby the first foldout section 28 can be pivoted from a first position overlaying the central section 26 to a second extended position where the first foldout section 28 does not overlay the central section. As shown in FIG. 1, the first foldout section 28 has a pocket 46 formed by a clear plastic panel 48 that is bonded, sewn, or otherwise secured along three of its edge portions to edge portions of a backing panel of the first foldout section. The edge portion of the clear plastic panel 48 adjacent the edge portion 34 of the central section 26 is not secured to the backing panel to provide an opening for the pocket 46 through which picture identification or other items can be inserted into and removed from the pocket 46.

The second foldout section 30 is rectangular and has an edge portion hingedly connected to the second edge portion 36 of the central section 26 whereby the second foldout section 30 can be pivoted from a first position overlaying the central section 26 and the first foldout section 28 to a second extended position where the second foldout section does not overlay the central section and the first foldout section. As shown in FIG. 1, the second foldout section 30 has a pocket 50 formed by a panel 52 with a series of parallel spaced apart slits 54 that is bonded, sewn, or otherwise secured along all four of its edge portions to edge portions of a backing panel of the second foldout section. Preferably, the pocket 50 and slits 54 are sized to receive conventional credit cards, debit cards, telephone cards, driver's licenses, etc.

The third foldout section 32 is rectangular and has an edge portion hingedly connected to the third edge portion 38 of the central section 26 whereby the third foldout section 32 can be pivoted from a first position overlaying the central section 26, the first foldout section 28, and the second foldout section 30 to a second extended position where the third foldout section does not overlay the central section, the first foldout section, and the second foldout section. As shown in FIG. 1, the third foldout section 32 has a pocket 56 formed by a panel 58 that is bonded, sewn, or otherwise secured along three of its edge portions to a backing panel of the third foldout section. The fourth edge portion 60 of the panel 58 is not secured to the backing panel to provide an opening for the pocket 56 through which coins and similar items can be inserted into and removed from the pocket 56. Preferably, the opening of the pocket 56 is provided with a flap 62 that can be releasably secured to the pocket 56 along the edge portion of the pocket adjacent the opening by a VELCRO® hook and loop fabric closure 64 or other conventional releasable closure to close the opening and retain coins or other items within the pocket 56.

As shown in FIG. 2, the central section 26, the second foldout section 30, and the third foldout section 32 of the multi-sectional wallet unit 22 have a common flexible external back panel 66 secured thereto. The external flexible back panel 66 is substantially coextensive with the central section 26, the second foldout section 30, and the third foldout section 32. The external flexible back panel 66 has three edge portions joined to the central section 26, the second foldout section 30, and the third foldout section 32 to form a pocket 68 with an opening 70 extending along a common edge of the central section 26, the second foldout section 30, and the third foldout section 32 for holding paper currency and/or similar items.

As shown in FIG. 2, the cellular telephone case 24 is formed by a pocket located on the outside of the flexible external back panel 66 behind the central section 26 of the multi-sectional wallet unit 22. The pocket is sized to form a case for holding a cellular telephone or similar item. The pocket is formed by a panel 72 that has side pleats to enable the pocket to expand and is bonded, sewn, or otherwise secured along three of its edge portions to the flexible external back panel 66. The fourth edge portion of the panel 72 is not secured to the flexible external back panel 66 to provide an opening 74 for the pocket through which a cellular telephone or similar item can be inserted into and removed from the pocket. Preferably, the pocket is provided with an elastic strip 76 or similar conventional closure means along the edge portion of the pocket adjacent the opening 74 to retain a cellular telephone or similar item within the pocket either by closing the opening 74 with the cellular telephone or item housed completely within the pocket or closing the opening of the pocket about the outside of the cellular telephone or item to grip a portion of the cellular telephone or item projecting from the pocket.

The second foldout section 30 and the third foldout section 32 are provided with a releasable fastening means for releasably holding the first, second, and third foldout sections in their first positions. Preferably, the releasable fastening means is a VELCRO® hook and loop fabric closure 78 consisting of pieces of fabric with small hooks bonded, sewn, or otherwise secured to one of the foldout sections 30 and 32 that sticks to corresponding pieces of fabric with small loops bonded, sewn, or otherwise secured to the other of the foldout sections 30 and 32. While the VELCRO® hook and loop fabric closure 78, as shown in FIGS. 1 and 2, is on the outside of foldout section 30 and the inside of foldout section 32, if desired, the closure 78 may be located on the inside of foldout section 30 and the outside of foldout section 32 so that the foldout section 30 could be folded over the foldout section 32 to secure the foldout sections 28, 30 and 32 in a closed position over the central section 26 of the multi-sectional wallet unit 22.

Preferably, the multi-purpose wallet/cellular telephone case also includes a strap, such as the neck strap 80, for securing the multi-purpose wallet/cellular telephone case 20 to a user so that the multi-purpose wallet/cellular telephone case does not have to be carried by hand. As shown in FIG. 2, the end portions of strap 80 are sewn or otherwise secured to the flexible external back panel 66; the midportion 82 of the strap is padded for user comfort; and the strap has a series of snap fasteners 84 joining two sections of the strap so that the length of the strap is adjustable.

Preferably, all of the panels of the multi-purpose wallet/cellular telephone case are made of flexible sheet materials such as but not limited to leather, nylon, plastic, and other sheet materials commonly used to fabricate wallets and cellular phone cases. A typical multi-purpose wallet/cellular telephone case 20, as viewed in FIG. 1, has a width "W" of about 8.5 inches; a height "H" of about 4.5 inches; and has rectangular sections 26, 28, 30 and 32 that are about 4.5 inches by about 2.8 inches. Typically, the pocket formed by the cellular telephone case 24, as viewed in FIG. 2, is about 2.75 to 3 inches in height; about 2 inches across; and about 1 inch in depth to accommodate a cellular telephone or similar item up to about 4.5 inches in height that will protrude from the case but be held within the case by the elastic strip 76; up to about 2 inches in width; and up to about 1 inch in depth. However, for certain applications, the size of the multi-purpose wallet/cellular telephone case and the cellular telephone case can be increased to accommodate larger size cellular telephones or similar items.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A multi-purpose wallet/cellular telephone case, comprising:

a multi-sectional wallet unit; the multi-sectional wallet unit having a central section and first, second, and third foldout sections that are integral with the central section; the central section being rectangular with first, second, third and fourth edge portions; the first edge portion being opposite the fourth edge portion and the second edge portion being opposite the third edge portion; the first foldout section being rectangular and having an edge portion hingedly connected to the first edge portion of the central section whereby the first foldout section can be pivoted from a first position overlaying the central section to a second extended position where the first foldout section does not overlay the central section; the second foldout section being rectangular and having an edge portion hingedly connected to the second edge portion of the central section whereby the second foldout section can be pivoted from a first position overlaying the central section and the first foldout section to a second extended position where the second foldout section does not overlay the central section and the first foldout section; the third foldout section being rectangular and having an edge portion hingedly connected to the third edge portion of the central section whereby the third foldout section can be pivoted from a first position overlaying the central section, the first foldout section, and the second foldout section to a second extended position where the third foldout section does not overlay the central section, the first foldout section, and the second foldout section;

the central section, the second foldout section, and the third foldout section having a common flexible back panel secured thereto; the flexible back panel being substantially coextensive with the central section, the second foldout section, and the third foldout section; the flexible back panel having three edge portions joined to the central section, the second foldout section, and the third foldout section to form a pocket for holding paper currency; an external pocket on the flexible back panel behind the central section for holding a cellular telephone;

the central section including key holding means;

the first, second, and third foldout sections being compartment sections having pockets for containing items; the first foldout section having a pocket with a clear window for viewing an item within the pocket of the first foldout section; the second foldout section having a plurality of pockets sized to retain cards having dimensions approximating a credit card; and the third foldout section having a pocket for holding coins and similar items which has an opening that is provided with a releasable fastening means, comprising fabric means with hooks and fabric means with loops that can be releasably interconnected, for closing the opening of the pocket of the third foldout section to retain items within the pocket of the third foldout section;

the external pocket for holding a cellular telephone having side pleats that enable the pocket to be expanded and an opening with elastic closure means for retaining a cellular telephone within the external pocket; and releasable fastening means, comprising fabric means with hooks and fabric means with loops that can be releasably interconnected, for releasably holding the first, second, and third sections in their first positions.

2. The multi-purpose wallet/cellular telephone case according to claim 1, including:

a strap means for carrying the multi-purpose wallet/cellular telephone case and/or securing the multi-purpose wallet/cellular telephone case to a user.

3. The multi-purpose wallet/cellular telephone case according to claim 2, wherein:

the strap means is a neck strap.

* * * * *